US008429782B2

(12) United States Patent
Russo

(10) Patent No.: US 8,429,782 B2
(45) Date of Patent: Apr. 30, 2013

(54) POLISHING SYSTEM, SUB-SYSTEM AND PADS

(76) Inventor: Timothy M. Russo, Livermore, CA (US)

( * ) Notice: Subject to any disclaimer, the term of this patent is extended or adjusted under 35 U.S.C. 154(b) by 209 days.

(21) Appl. No.: 13/049,084

(22) Filed: Mar. 16, 2011

(65) Prior Publication Data

US 2012/0238190 A1 Sep. 20, 2012

(51) Int. Cl.
*A47L 11/14* (2006.01)
*B05C 1/00* (2006.01)

(52) U.S. Cl.
USPC ..... 15/97.1; 15/230; 15/230.1; 451/526

(58) Field of Classification Search ..... 15/97.1, 15/230, 230.1, 98, 230.17–230.19; 451/357, 451/446, 526, 490
See application file for complete search history.

(56) References Cited

U.S. PATENT DOCUMENTS

| | | | | |
|---|---|---|---|---|
| 2,075,217 | A * | 3/1937 | Milburn | 215/395 |
| 3,104,783 | A | 9/1963 | Hall | |
| 3,277,924 | A | 10/1966 | Nezworski | |
| 4,149,294 | A | 4/1979 | MacKay, Jr. et al. | |
| 4,188,682 | A | 2/1980 | Burglin et al. | |
| 4,686,918 | A | 8/1987 | Hjalmer et al. | |
| 4,689,922 | A | 9/1987 | Blanchard, Jr. et al. | |
| 4,692,958 | A | 9/1987 | McMakin | |
| 4,731,894 | A | 3/1988 | Ashworth | |
| 5,123,139 | A | 6/1992 | Leppert et al. | |
| 5,138,735 | A | 8/1992 | Kusz et al. | |
| 5,375,289 | A | 12/1994 | Miyaoka | |
| 5,638,993 | A | 6/1997 | Hing | |
| 5,649,508 | A * | 7/1997 | Rost et al. | 222/191 |
| 5,938,515 | A | 8/1999 | McLain et al. | |
| 5,954,237 | A | 9/1999 | Lampe et al. | |
| 6,044,512 | A | 4/2000 | Hornby et al. | |
| 6,223,383 | B1 * | 5/2001 | VanPutten | 15/230 |
| 6,298,518 | B1 * | 10/2001 | Umbrell | 15/230.1 |
| 6,413,238 | B1 | 7/2002 | Maget | |
| 6,422,926 | B1 * | 7/2002 | McLain et al. | 451/63 |
| 6,523,215 | B2 | 2/2003 | Piombini | |
| 6,560,806 | B1 | 5/2003 | Lawson et al. | |
| 6,655,866 | B1 | 12/2003 | Morad et al. | |
| 6,669,391 | B2 | 12/2003 | Policicchio et al. | |
| 6,783,448 | B2 | 8/2004 | Sabo | |
| 6,807,705 | B2 | 10/2004 | Piombini | |
| 6,895,631 | B1 * | 5/2005 | Krause et al. | 15/230 |
| 7,115,018 | B1 | 10/2006 | Syverson | |
| 7,364,499 | B1 | 4/2008 | Karppinen et al. | |
| 7,906,051 | B2 * | 3/2011 | McLain | 264/162 |
| 2002/0166573 | A1 | 11/2002 | Policicchio et al. | |
| 2004/0103490 | A1 * | 6/2004 | Long et al. | 15/22.1 |
| 2006/0016037 | A1 * | 1/2006 | Flora et al. | 15/228 |
| 2006/0107482 | A1 | 5/2006 | Krause et al. | |

(Continued)

*Primary Examiner* — Shay Karls
(74) *Attorney, Agent, or Firm* — Law Office of Alan W. Cannon

(57) ABSTRACT

Polishing systems, subsystems and pads adapted for use in conjunction with a polisher. A relatively incompressible backing pad is configured to be attached to a drive system of the polisher. The backing pad includes at least one substantially straight backing pad edge along a perimeter thereof. A relatively compressible polishing pad is configured to be attached to the backing pad, to be driven in contact with a surface to be polished. The polishing pad includes at least one substantially straight polishing pad edge along a perimeter thereof corresponding to the at least one substantially straight backing pad edge when the polishing pad is attached to the backing pad.

33 Claims, 9 Drawing Sheets

U.S. PATENT DOCUMENTS

2007/0012727 A1 1/2007 Licari
2008/0223887 A1* 9/2008 Mills ..... 224/148.6
2009/0124184 A1 5/2009 Greer
2010/0095470 A1 4/2010 Umbrell

* cited by examiner

POLISHING SYSTEM, SUB-SYSTEM AND PADS

FIELD OF THE INVENTION

The present invention relates to polishing pads, assemblies and systems useful for removing defects such as scratches or improving clarity of a surface such as a painted surface or a coated surface.

BACKGROUND OF THE INVENTION

With substrate coatings such as those used on the surface of automobiles changing and causing coatings to become softer and more impressionable, there is a need for an easier way to remove scratches, dull luster and defects from a painted or coated surface without leaving behind finite circular scratches more commonly known as swirl marks. In the past coatings were of high solids and dried very hard. When the surface was damaged by minor surface scratches or faded from ultraviolet rays, reconditioning technicians used heavy, abrasive compounds and a high speed buffer or polisher with a wool pad to cut through the coating material to remove paint composition and repair the damage or restore the clarity.

Since at least the 1970's, high-speed circular polishers or buffers have been the most effective way to repair damage to a substrate coating material. These buffer/polishers are capable of speeds to 3000 rpm and are used in combination with liquid abrasive compounds and also with polishes containing finer materials to polish the surface or remove defects. These materials are applied using the polisher and a polishing pad. The polishing pad can consist from a wide variety. The polishing pads that are currently commercially available are of a circular configuration and are designed for spinning in a complete rotation at high speeds which can reach 3,000 revolutions per minute (RPM). Polishing pads can be constructed of wool, synthetic fiber or polyurethane foam. The pad is affixed to a circular backing pad. The backing pad is circular and flat, although some can be circular with a very slight conical shape. The most common way to connect the pad to the backing pad is to use a hook and loop type fastener, a specific version of such is also known under the trade mark of VELCRO. One portion, generally the hook portion, of the fastening material is affixed to the lower face side of the backing pad. The other side, typically the loop portion, of the fastener is provided on the back (top) side of the polishing pad, so it can be readily attached to (and detached from) the backing pad to allow for a quick change without use of any tools or adhesives.

There are certain disadvantages inherent in the use of a high-speed polisher to treat a substrate coating. It takes a person of considerable skill in the art to operate the high speed polisher properly and effectively. Even when a skilled operator is using the high-speed polisher there is still a fairly significant risk of damaging the coated surface by staying in one area too long and/or using too aggressive of a compound and/or applying too great a pressure and/or polishing at too high a speed, any and all of which can result in overheating of the substrate coating, resulting in melting of the coating (sometimes referred to as "burning" the finish, coating or paint)

Another disadvantage results when using the wrong pad and/or the wrong polishing material. This can result in leaving finite circular scratches in the surface, more commonly known as swirl marks.

Still another disadvantage is owing to the facts that the pad is circular and spinning at high speed. These characteristics make it difficult for the operator to get close to trim moldings, emblems, antennas and panel edges on vehicles without damaging them or leaving a lot of wax or polishing material in, on, or under them. Furthermore the high speed polisher can damage trim moldings, emblems and other parts as many are constructed of plastic or other soft materials. These parts can also be burned by the pad briefly coming in contact with the surface.

High Speed polishers also produce splatter. Splatter is caused when polishing material is applied on the surface and the polisher connects with that material while spinning at a high rate of speed. The polishing pad is not able to absorb the material sufficiently before the high rotating speed of the pad energizes it in an outward radial/tangential direction. The excess polishing material is then spun or sprayed away by the buffing pad that is spinning in a circular motion at a high rate of speed.

Another polisher dating back to at least the 1980's is the dual-action or random orbital polisher. Dual-action/random orbital polishers have also been used for many years, mostly for final finishing. The most common uses are for the application of wax or mild polish. The dual-action polisher operates in two ways. It oscillates in a back and forth orbital motion while also spinning in a circular motion very slowly at random. This causes the polishing pad to perform two duties: small oscillations and complete full circular revolutions. Most dual-action polishers nm in a range from 4,000-6,000 orbits per minute or OPM. The dual-action polisher also uses the same polishing pads as the high-speed polisher as they are often interchangeable if there is a VELCRO backing pad installed on the polisher.

The dual-action or random orbital polisher also has disadvantages. As it is shaped like the high speed polisher, it too uses a circular pad and backing pad that makes it difficult to get close to trim moldings, emblems, door handles, antennas and panel edges. It also spins, although at a slower rate, but it is still difficult for the user to operate and control the dual-action or random orbital polisher around trim moldings, emblem, door handles, antennas and panel edges. The circular pad oscillating makes it difficult to treat the substrate surface adjacent the above-mentioned features, as many of them have, at least in part, straight edges or limits. As a result, there is a control issue and the dual-action polisher can also load wax or polish in, on, under or around these areas.

Another polisher dating back to at least the 1980's is the orbital polisher. The orbital polisher operates in the same manner as the dual action polisher, in that it oscillates in a back and forth orbital motion while also randomly spinning in a flail circular motion, although at a lower speed or lower orbits per minute (OPM's) than the dual action polisher. Orbital polishers are shaped differently than the dual action polishers and high speed polishers, as they are generally bigger and bulkier and do not have an arm or grip extending therefrom. Instead, orbital polishers typically have a generally circular shape with a handle or grip extending upward from the main body (i.e., in a direction substantially normal to the polishing pad, extending away from the polishing pad). Orbital polishers use a different type of polishing pad than dual action polishers, typically a circular bonnet that is constructed from a cotton material. The bonnet is attached to the polisher by use of an elastic strip affixed to the outer edge of the material, much like the way a shower cap is attached to a person's head during use. The bonnet is attached to compressible foam that is connected to an incompressible circular backing plated connected to the drive motor of the polisher.

Orbital polishers also have disadvantages. They are generally big, bulky and cumbersome to operate. Like the circular polishers, orbital polisher also have a circular polishing pad/bonnet and therefore it is difficult to navigate around moldings, door handles, antennas and panel edges. Orbital polishers are also unable to remove damage to a surface such as a minor surface scratch, swirl mark or dull luster. Orbital polishers are typically used in the application of wax or application of protective agents to a surface. The bonnets that they use also have disadvantages, such as they cannot be cleaned as easily as a foam polishing pad. They must be removed and washed with a liquid cleaner, and then dried before they can be used again.

There are ongoing, unmet needs for improved polishing pads, polishing assemblies and polishing systems that overcome the above-stated disadvantages. The present invention meets those previously unmet needs and more.

SUMMARY OF THE INVENTION

In one aspect of the present invention, a polishing system adapted for use in conjunction with a polisher is provided, including: a relatively incompressible backing pad configured to be attached to a drive system of the polisher, the backing pad comprising at least one substantially straight backing pad edge along a perimeter thereof, and a relatively compressible polishing pad configured to be attached to the backing pad, to be driven in contact with a surface to be polished, the polishing pad comprising at least one substantially straight polishing pad edge along a perimeter thereof corresponding to the at least one substantially straight backing pad edge when the polishing pad is attached to the backing pad.

In at least one embodiment, the backing pad comprises a rectangular backing pad perimeter and the polishing pad comprises a rectangular polishing pad perimeter.

In at least one embodiment, the backing pad includes a wavy edge.

In at least one embodiment, the polishing pad includes a wavy edge.

In at least one embodiment, the backing pad comprises a substantially planar backing surface to which the polishing pad is attachable, the backing pad thither comprising a recess extending inwardly from the substantially planar backing surface along a portion of the backing surface, the recess configured as a capacity for a polishing substance.

In at least one embodiment, the recess extends from the perimeter, inwardly toward a center of the backing surface.

In at least one embodiment, the recess is angular in shape with a largest portion of the angular shape opening outwardly toward the perimeter of the backing pad.

In at least one embodiment, the polishing pad forms a void along a portion of a leading edge thereof, between the polishing pad leading edge and a substrate, when a portion of the polishing pad is attached to the recess and the polishing pad is contacted to the substrate.

In at least one embodiment, a raised portion of the polishing pad results from attaching the polishing pad to the recess.

In at least one embodiment, the system is provided in combination with the polisher.

In at least one embodiment, a dispenser mount is attached to the polisher and configured to releasably hold a polishing substance dispenser therein.

In at least one embodiment, the polisher comprises an orbital polisher.

In at least one embodiment, the combination further includes a polishing substance dispenser releasably mounted in the dispenser mount.

In another aspect of the present invention, a backing pad for a polishing system adapted for use in conjunction with a polisher is provided. The backing pad is a relatively incompressible backing pad configured to be attached to a drive system of the polisher. The backing pad includes at least one substantially straight backing pad edge along a perimeter thereof.

In at least one embodiment, the backing pad comprises a substantially planar backing surface configured to be attached to a polishing pad. The backing pad further includes a recess extending inwardly from the substantially planar backing surface along a portion of the backing surface, the recess configured as a capacity for a polishing substance.

In at least one embodiment, the recess extends from the perimeter, inwardly toward a center of the backing surface.

In at least one embodiment, the recess is angular in shape with a largest portion of the angular shape opening outwardly toward the perimeter of the backing pad.

In at least one embodiment, at least one compressible strip is attached to the perimeter of the backing pad and extends upwardly from the substantially planar surface. Each compressible strip is provided to prevent marring due to contact of the relatively incompressible backing pad with a surface that it might otherwise contact during a polishing operation.

In at least one embodiment, fastening material is affixed to the substantially planar surface. The fastening material is configured to releasably attach to mating fastening material on a polishing pad.

In another aspect of the present invention, a polishing pad for a polishing system is adapted for use in conjunction with a polisher. The polishing pad is a relatively compressible polishing pad configured to be attached to a relatively incompressible backing pad, to be driven in contact with a surface to be polished. The polishing pad includes at least one substantially straight polishing pad edge along a perimeter thereof, configured to correspond at least one substantially straight backing pad edge when the polishing pad is attached to the backing pad.

In at least one embodiment, a recess is provided in a back surface of the polishing pad, wherein a perimeter portion of the backing pad extends upwardly from the recess along and externally of a perimeter of the recess. The perimeter portion has a height sufficient to prevent marring that would otherwise be caused by contact of the relatively incompressible backing pad with a surface when the polishing pad is attached to the backing pad.

In at least one embodiment, the perimeter of the polishing pad is rectangular.

In another aspect of the present invention, a polishing system is provided, including: a main body including a motorized drive system; a relatively incompressible backing pad attached to the drive system, the backing pad configured to be attached to a relatively compressible polishing pad for driving the pad in contact with a surface to be polished; and a dispenser mount attached to the main body and configured to releasably hold a polishing substance dispenser in an orientation for dispensing the polishing substance on the surface to be polished while the polishing pad is in contact with the surface to be polished.

In at least one embodiment, a polishing substance dispenser is releasably mounted in the dispenser mount.

In at least one embodiment, a substantially compressible backing pad is removably fixed to the backing pad, wherein the backing pad comprises at least one substantially straight backing pad edge along a perimeter thereof, and wherein the polishing pad comprises at least one substantially straight polishing pad edge along a perimeter thereof corresponding to the at least one substantially straight backing pad edge.

In at least one embodiment, the system comprises an orbital polisher.

These and other features of the invention will become apparent to those persons skilled in the art upon reading the details of the systems, subsystems and pads as more fully described below.

DETAILED DESCRIPTION OF THE INVENTION

Before the present systems, pads and assemblies are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "an", and "the" include plural referents unless the context clearly dictates otherwise. Thus, for example, reference to "a strip" includes a plurality of such strips and reference to "the edge" includes reference to one or more edges and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

Figure 1:
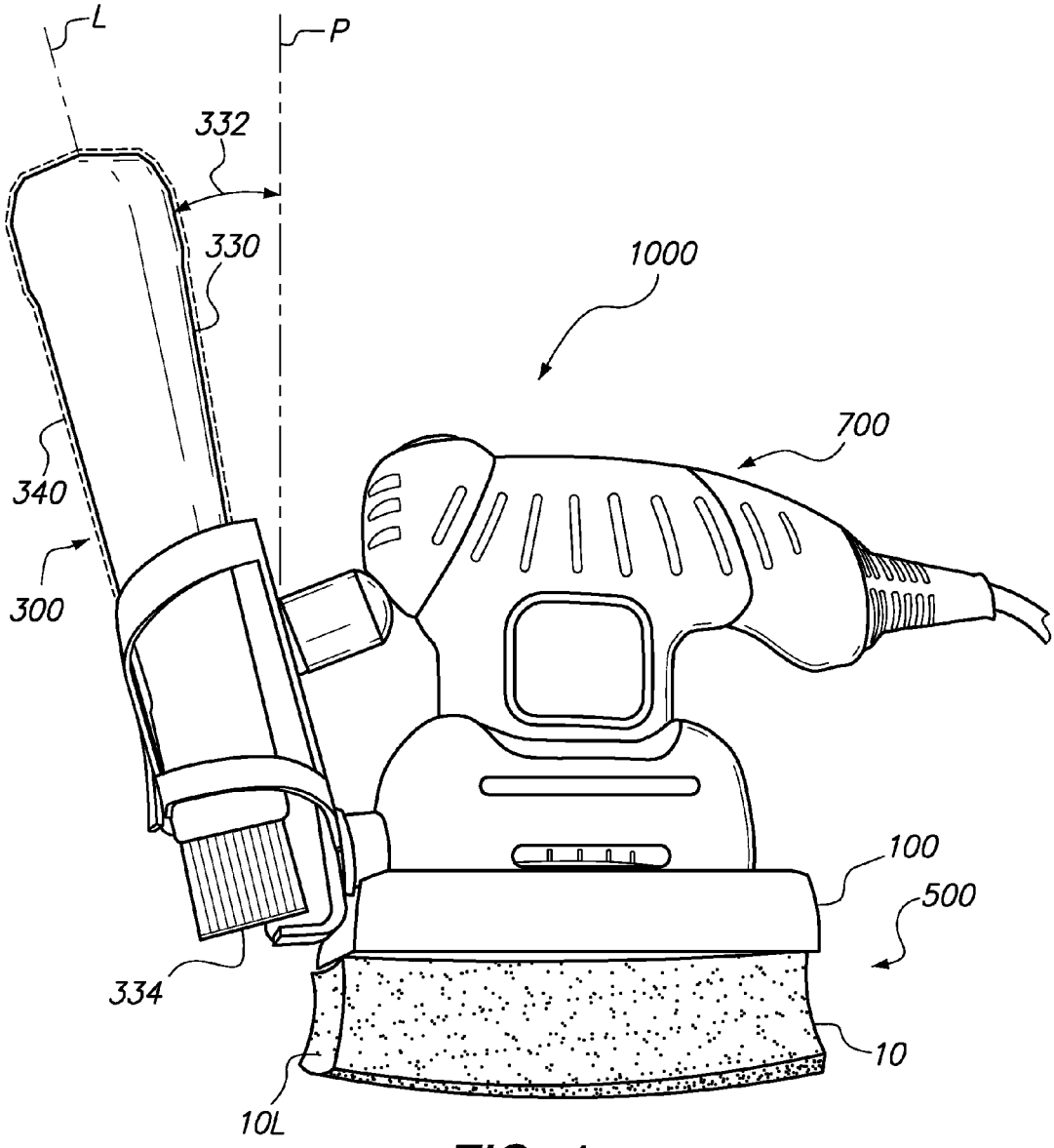
FIG. 1 is a left side view of a polishing system according to an embodiment of the present invention.
Figure 10:
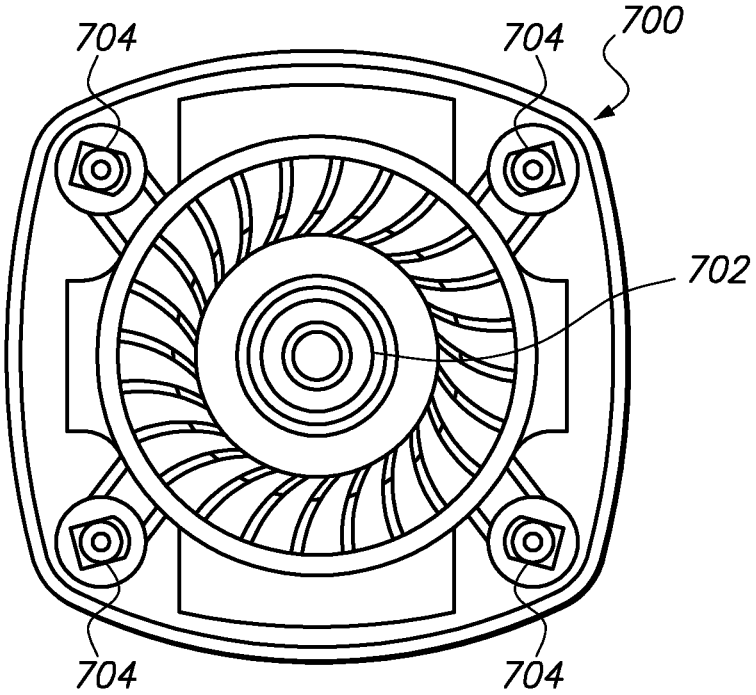
FIG. 10 illustrates a bottom end of a polisher with the backing pad removed.

FIG. 1 is a left side view of a polishing system 1000 according to an embodiment of the present invention. The system includes a polisher 700, such as the orbital polisher 700 shown in FIG. 1, which may be, for example, a Black and Decker FS 540 Type 1 (Towson, Wyo.), or a similar polisher from Makita or other manufacturer that produces this type of orbital polisher. Alternatively, other types of orbital polishers may be substituted, including, but not limited to those described above. A polishing subsystem 500 is attached to a bearing 702 (see FIG. 10) attached to the drive motor of the polisher 700, via a receptacle 170 (see FIG. 5C) formed on the top surface of backing pad 100 that forms a press fit with bearing 702 as bearing 702 is received in receptacle 170. Additionally, screws, bolts, rivets or other fixing members (typically machine screws) are inserted through openings/holes 104 and attached (typically by mating threads) to flexible posts 704 attached to polisher 700. By fixing to posts 704 in this manner, backing pad 100 is prevented from spinning like a rotational polisher, but since posts 704 are flexible, they still allow the backing pad to oscillate as driven by the oscillations of the bearing 702 driven by the drive motor, since posts 704 flex sufficiently to permit the oscillation movements of the backing pad 100.

Polishing subsystem 500 includes a relatively incompressible backing pad 100 and a relatively compressible polishing pad 10. The term "relatively incompressible" used to modify the backing pad 100 means that the backing pad is substantially less compressible than the "relatively compressible" polishing pad. Thus, although the backing pad 100 may have some compressibility, even then it is significantly less compressible than the polishing pad 10 and provides support for the polishing pad 10. In use, the backing pad 100 can be considered incompressible (i.e., when forces typical of those used during polishing are applied thereto), while the polishing pad 10 is compressible during use, and compresses when forces typical of those used during polishing are applied thereto. The backing pad 100 may be made from a substantially rigid and or tough plastic that may optionally include a thin layer of compressible material on its bottom face (as viewed in the orientation of FIG. 1, for example). Alternatively, backing pad 100 may be made from rubber, fiberglass, carbon fiber and/or metals such as steel, cast iron, aluminum and the like.

Polishing pad 10 is configured and dimensioned to be attached to the backing pad 100, as shown. Accordingly, the perimeter of the polishing pad 10 has substantially the same shape as the shape of the perimeter of the backing pad and is dimensioned to interface with the backing pad 100. Polishing pad 10 is made from a compressible material, and may be made from sponge foam (e.g., open-cell polyurethane or the like), synthetic and/or natural fibers (such as tufted wool or the like), or microfiber cloth such as microfiber cloth constructed on a blend of polyester and polyamide, or other materials currently known and used in the art for making polishing pads.

Figure 2:
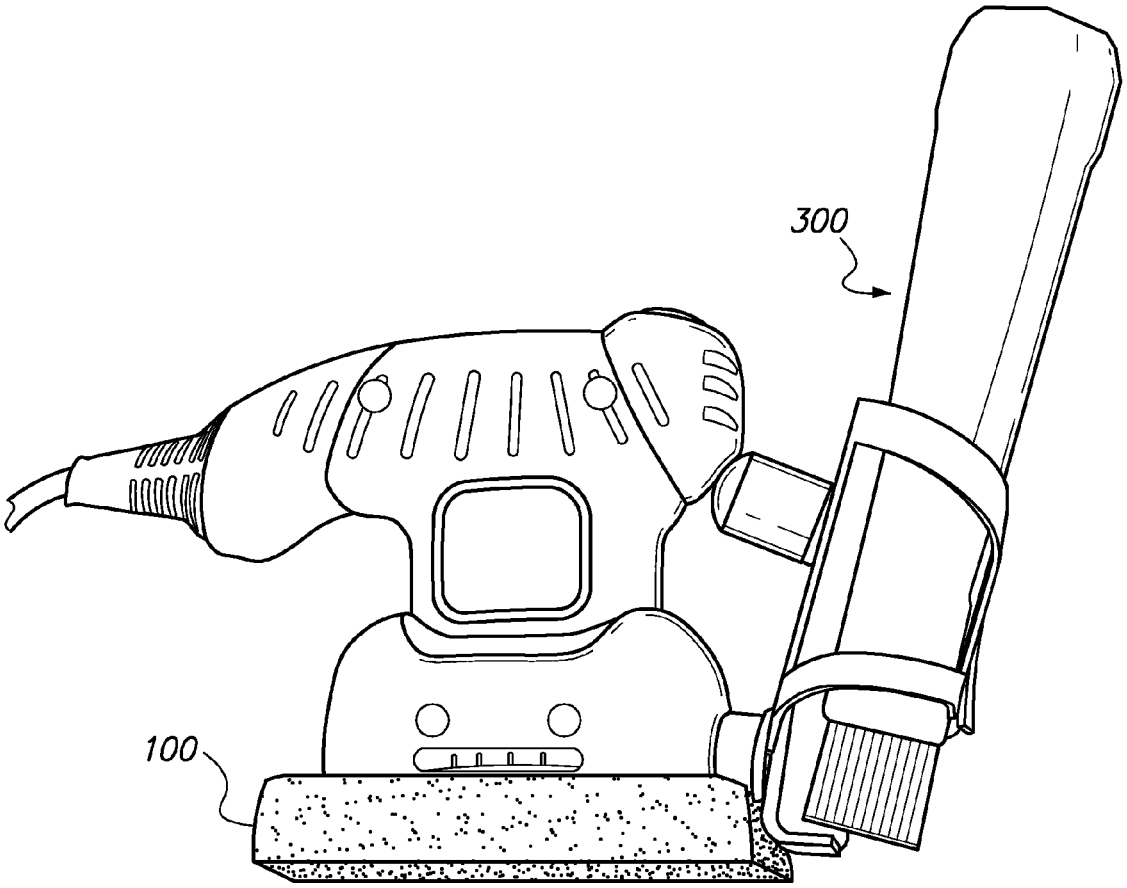
FIG. 2 is a right side view of the system of FIG. 1, except that the polishing pad has been removed.
Figure 3:
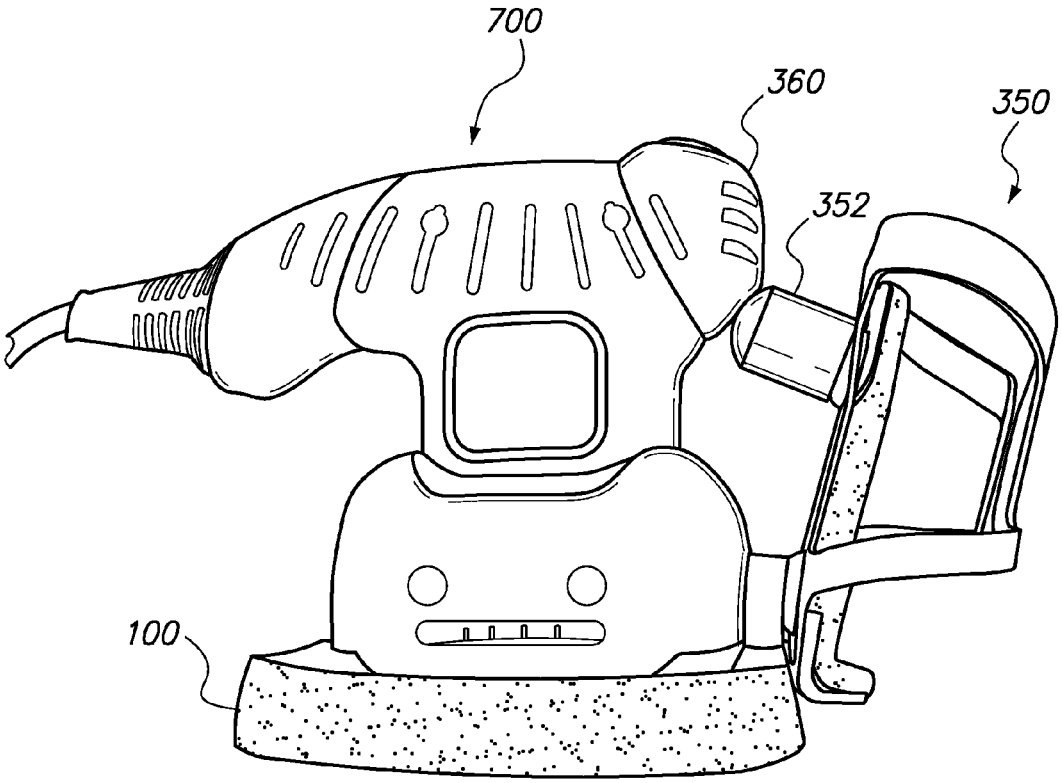
FIG. 3 is a right side view of the system shown in FIG. 2, wherein, additionally, the substance dispenser has been removed.

System 1000 may further include a dispensing subsystem 300 as shown in FIG. 1. FIG. 2 shows a right side view of system 1000 with the polishing pad 10 having been detached from the backing pad 100. A dispenser mount 350 of the subsystem 300 is shown most clearly in FIG. 3 with the substance dispenser 33 having been removed. Dispenser mount 350 may be made of aluminum, stainless steel, structural plastic or the like, and is configured and dimensioned to receive substance dispenser 33 therein, as shown in FIGS. 1-2. The substance dispenser may be readily removed, such as for the purpose of refilling the substance therein, or for any other reason the user may have. The dispenser mount 350 may loosely receive the substance dispenser/container 330 therein, but preferably forms a friction or snap fit therewith to hold it securely in the desired orientation. In one embodiment, dispenser mount 350 is configured to form a secure, snap fit with the dispenser 330 like the manner in which a bicycle water bottle is received in a water bottle cage. In another embodiment, dispenser mount 350 forms a friction fit with dispenser 330. The dispenser mount 350 may optionally include a retention strap 340 (as illustrated in phantom in FIG. 1) that attaches to front and back sides of the mount 350 and cradles the end of the dispenser 350 that is opposite the dispensing nozzle 334. In use as illustrated in FIG. 1, retention strap provides additional support to dispenser 330 and ensures that it does not become unintentionally dislodged from the dispenser mount 350 during use. This feature can be particularly helpful when the system 1000 is tilted sideways, such as when polishing a door, or the like. Optional retention strap is preferably elastic so that it provides even further assistance with vibration absorption during use and snugly retains the dispenser 330. Alternatively, retention strap could be made of leather, cloth, or other flexible material having suitable mechanical properties to perform he retention function. At least one end of the strap 340 is preferably releasably attached to dispenser mount 350 to allow for quick and easy interchange of dispensers 330.

The dispenser mount 350 is attached to the polisher 700 (preferably to the front, as shown) by screws, bolts, rivets, welding or the like. Further alternatively, such attachment may be accomplished by molding the dispenser mount 350 integrally with the body of the polisher 700 or otherwise integrating the dispenser mount 350 with the body of the polisher 700, for example. Optionally, one or more bushings or bumpers 352 may be provided between the dispenser mount 350 and polisher 700 to dampen vibration of the subsystem 300 when miming the motor of the polisher 700. Alternatively, bushings or bumpers may be rigid, but have sufficient length to provide an adequate space between the dispenser mount 350 and hand grip 360 to allow hand grip 360 to be comfortably gripped by the hand of a user without interference from the dispenser mount 350. The dispenser mount 350 is mounted and configured to hold the dispenser 330 in an orientation that is angled with respect to a perpendicular P to the plane of the surface of the backing pad 100, as shown in FIG. 1 (longitudinal axis L of dispenser 330 is angled 332 relative to perpendicular P). This angle is provided to provide the gap mentioned above, so as to allow easy grasping of the grip 350 without interference by the dispenser mount 350, but it also points the nozzle 334 more toward the leading edge 10L of the polishing pad, for better placement of the substance being dispensed from dispenser 330. In the embodiment of FIG. 1, angle 332 is about twelve degrees. Typically angle 332 is in the range of about ten to twenty degrees, but may be in the range of about zero to about forty degrees.

When an operator is performing a polishing operation, the operator can simply squeeze the dispenser bottle 330 to dispense a substance used for the operation, without ever having to take his other hand off of the polisher 700. This operation can be performed with the motor of the polisher stopped or while the motor continues to nm the polisher. Since the operator does not have to completely release his hold on the polisher to retrieve a source of polishing substance, then apply the substance, then put down the source of polishing substance before again picking up the polisher, subsystem 300 is a substantial convenience and time saver. A pressure-relief valve (not shown) is positioned within nozzle 334 to prevent dripping of the substance out of the nozzle 334, even when the dispenser 330 is fully loaded and is being vibrated by operation of the polisher. However, when the operator squeezed the dispenser 330 this increases the pressure of the substance on the pressure relief valve, the pressure exceeds the opening pressure required to open the pressure relief valve, and substance is dispensed through the valve and nozzle 334 and onto the surface being polished, at a location directly in front of the leading edge 10L of the polishing pad 10. When the operator ceases squeezing the dispenser, the pressure of the substance on the pressure relief valve drops back down below the actuation pressure and the valve automatically closes, thereby preventing any further dispensation of the substance until the dispenser is squeezed again. Examples of substances that can be dispensed by dispenser 330 include, but are not limited to: surface protectors like waxes and paint guard products designed to provide enhanced durability and to help protect a substrate coating, polishing products designed to remove minor surface damage like dull luster or minor surface scratches, etc., glazing products that are designed to stay wetter for extended working time, compounding products that may or may not contain abrasives designed for heavier coating repairs like acid rain damage, surface contamination, deep or heavy scratches, or overall poor paint condition. The above are non-limiting examples, as the present invention is not limited to use of the listed types of substances or repair techniques.

Dispenser 330 further has a removable cap 336 that can be removed for refilling the substance and then put back on the dispenser 330 to close it off again. Such removal and replacement is typically performed using mating threads, although other mechanisms may be substituted, as the system is not limited to caps with threads. For example, a threaded plug might additionally or alternatively be installed elsewhere on the dispenser, such as at the opposite end. If placed at the opposite end (on top in FIGS. 1-2), this would allow refilling to be performed without the need to even remove the dispenser 330 from the mount 350. Other mechanisms such as sealed hatches, latches, etc., may also be employed additionally or alternatively to mating threads. Still further, in another embodiment, dispenser 330 does not include any removable cap or plug, but instead is disposable and has only a nozzle and valve formed therein as described above. In such a disposable embodiment, the user would simply remove the dispenser 330 after emptying its contents, and replace it with another prefilled, disposable dispenser.

Referring now to FIGS. 4A-4D, various exemplary embodiment of backing pad 100 are shown. Each backing pad 100 includes at least one substantially straight backing pad edge 100S along a perimeter thereof. Straight edge 100*s* allows mounting a polish pad 10 having a similar straight edge and using the polishing system to polish immediately adjacent moldings, mirrors, door handles and other features mounted on the polishing surface, without damaging these features and greatly reducing occurrences of leaving polishing substances on, in or under these features. At the same time, the straight edge allows the surface to be polished much closer, while also providing a greater coverage area to reduce time spent working around these areas and can therefore be carried out much more effectively than that which is possible with a circular pad. The corners of the pads 100 formed where two edges join may be angular 100A, rounded 100R, or any combination of the two. The angle 100*a* formed at an angular corner may be ninety degrees, as in the case of a rectangular pad 100 (FIGS. 4A, 4C) or a square pad 100 (FIG. 4A), but may be an acute angle or an obtuse angle in other embodiments. An angled corner 100A may be advantageous for polishing in a corner or other tight confines of a surface being polished. This may be particularly advantageous when the corner 100*a* has an acute angle. Rounded corners 100R may provide the advantage of thither reducing the risk of damage to moldings and other features, as the rounded corners are less sharp and thus less likely to cause breakage or chipping of features. At the same time, the rounded corners also reduce the risk of tearing or otherwise damaging the polishing pad or compressive strips (described below) that cover the corners.

Figure 4A:
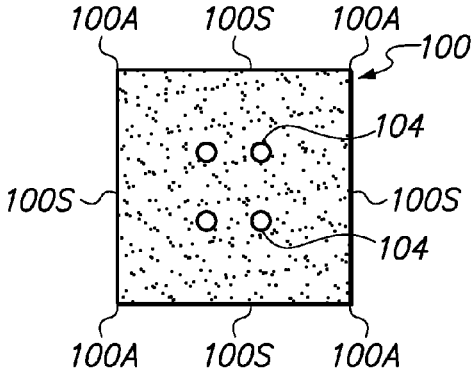
FIGS. 4A-4E illustrate various embodiments of backing pads according to the present invention.
Figure 4B:
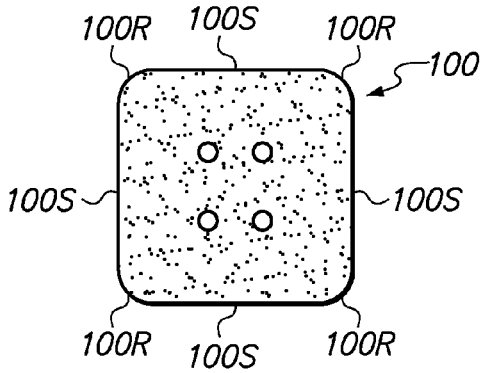
Figure 4C:
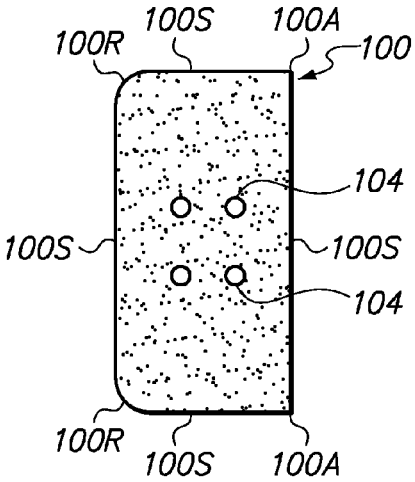
Figure 4D:
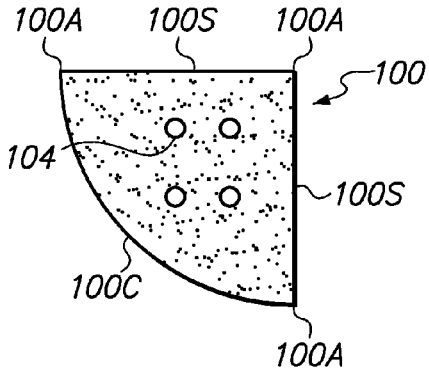
Figure 4E:
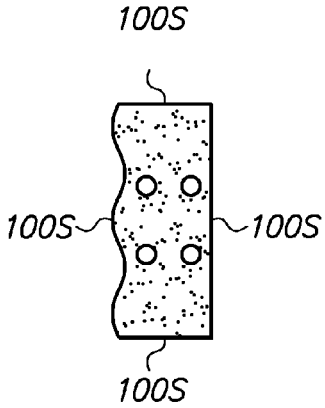

FIG. 4B shows a substantially square backing pad 100 in which all corners are rounded corners 100R. FIG. 4C shows a substantially rectangular pad 100 in which corners 100R are rounded on one side and corners 100A are angled on the other side. In the embodiment of FIG. 4D, one edge 100C is curved, while the other two edges 100S are substantially straight, and all corners 100A are angled. It is noted here that FIGS. 4A-4D are not limiting to the invention, as other configurations may be provided, as long as at least one straight edge 100S is included. For example, FIG. 4E shows a backing pad 100 having substantially straight edges 100S. The left side edge 100S has a slight undulation, but it is substantially straight in that the undulations alternate so that the edge 100S extends, on average, in a substantially straight direction over the entire length of the edge 100S. All of the substantially straight edges of backing pad 100 may be straight, or one or more may be wavy, having a slight undulation, but still being substantially straight. Likewise all of the substantially straight edges of polishing pad 100 may be straight, or one or more may be wavy, having a slight undulation, but still being substantially straight.

Fastening features 104 such as through holes are provided through each embodiment of backing pad 100 that allows it to be fastened to the body of the polisher 700, specifically, to the posts 704, as noted above. In the embodiments shown, a four screw- or bolt-hole pattern of fastening features 104 is provided to allow four screws, bolts or studs to be inserted therethrough and fastened to the posts 704 of the polisher, using mating threads or other fastening expedient. The four-hole pattern is not limiting of the invention, as pads 100 will be provided with the number of holes 104 and in the pattern required to match what is present on the body of the polisher 700 (posts 704 or some other pattern of features to be fastened to) to which the backing pad 100 is to be fastened. Also, the holes of the fastening features 104 are typically countersunk so that the heads of the fasteners (screws, bolts or studs) inserted with be recessed within the backing pad 100 to prevent scratching or other damage that might otherwise be caused if the heads were flush with the lower surface of the backing pad or extending therefrom.

Figure 5A:
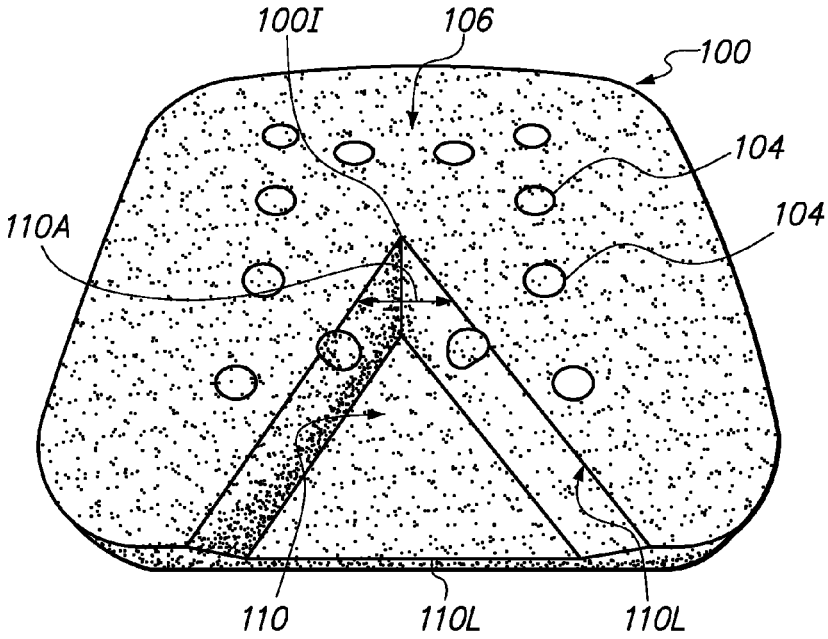
FIGS. 5A-5C illustrate various embodiments of backing pads each having a recess according to various embodiment of the present invention.
Figure 5B:
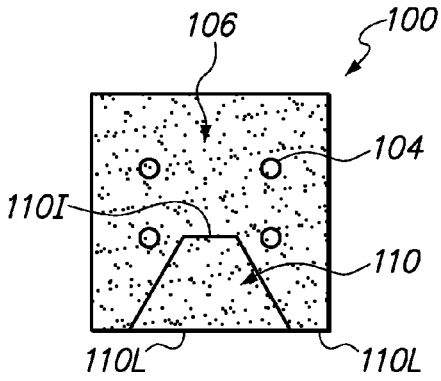
Figure 5C:
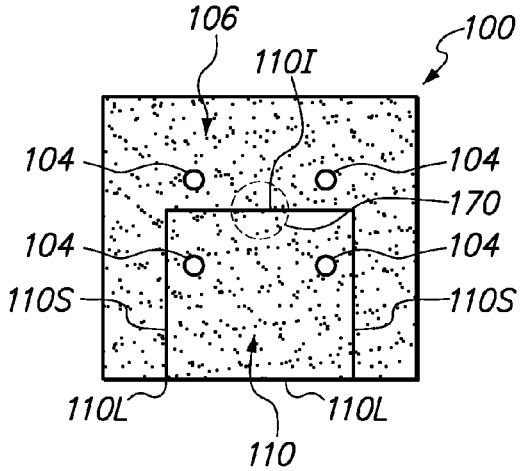

FIGS. 5A-5C illustrate various embodiments of backing pads 100 that include another advantageous feature of the present invention. Backing pad 100 has a substantially planar lower (backing) surface 106 configured to allow a polishing pad 10 thereto, and to back the polishing pad 10 to provide with a substantially planar, substantially incompressible surface that supports the compressible polishing pad 10 while polishing of a substrate is being carried out. The entire lower surface (except for fastening features 104) may be substantially planar. Alternatively, as illustrated in FIGS. 5A-5C, a majority (i.e., greater than 50%) of the backing surface 106 is substantially planar, but the backing pad 100 thither includes a recess 110 extending inwardly (that is above, when orientated as in FIGS. 1-3) from the substantially planar backing surface 106 along a portion thereof. Recess 110 typically takes up about five to about forty percent of the backing surface, up to slightly less than fifty percent, typically about ten to about twenty percent, and, in at least one embodiment, about fifteen percent.

Figure 9A:
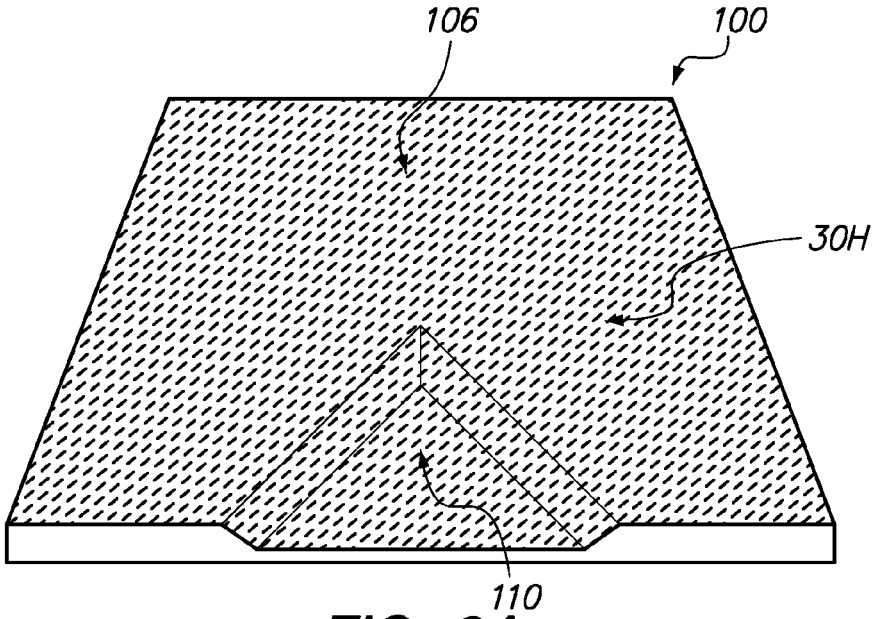
FIGS. 9A-9B illustrate alternative embodiments of fasteners attached to the bottom surface of a backing pad according to the present invention.

Recess 110 is configured to provide a space or capacity and to assist in containing a polishing substance in the capacity to be used later in the performance of a polishing operation. Thus for example, as a polishing substance is applied to the substrate to be polished, as the leading edge 10L of the polishing pad 10 is advanced into the volume of polishing substance on the substrate to be polished, a portion of the volume of the polishing substance is captured in the volume of the recess 110 and for drawn further into the polishing pad than in areas of the polishing pad that do not interface with the recess 110. This not only helps to prevent excess polishing substance from being simply pushed out of the path of polishing, but it also provides a reserve of polishing substance to the polishing pad, so that the polishing pad does not dry out as quickly as it otherwise would if the backing surface 106 of backing pad 100 did not include recess 110. This in turn extends the polishing time before there is a need for more polishing substance to be applied, either from dispenser 330 or from another external source. As the polishing pad 10 begins to use up the polishing substance taken up by the porosity 10P of the pad 10 itself, more polishing substance is applied to the substrate by applying a slight pressure to the front of the polisher 700 and using a backward motion to release contained polishing substance from recess 110 and pores of the pad 10 thereby forcing the polishing substance to the bottom surface and leading edge 10L of the polishing pad 10 with some of the polishing substance extending onto the substrate being polished, This therefore extends the polishing time by re-supplying the substrate with polishing substance. Additionally, when attachment material 30 is provided on the recess and on the portion of the top surface of pad 10 that interfaces with the recess 110 when pad 10 is attached to pad 100, the recess 110 also assists in creating a slight void 10V along the leading edge 10L of the pad 10. Thus, for example, FIG. 9A illustrates an embodiment in which a hook portion 30H of attachment/fastener 30 is provided on the bottom face of backing pad 100, including recess 110, where fastener 30H is adhered to and follows the contours of the recess 110. Additionally, polishing pad 10 is provided with a loop portion 30L on the top surface of pad 10, including the top surface area that interfaces with and attached to the recess 110. As shown in FIG. 9C, this results in a slight void 10V along the leading edge 10L of the polishing pad. This allows the polisher 700 to be in an operational mode while a volume of polishing substance is being applied to the substrate being polished. With a slight pressure applied to the back end portion of the polisher 700, the polisher 700 can be advanced forward so that the leading edge 10L of the pad 10 passes over the top of the volume of polishing substance without spraying or spitting polishing substance about. Rather, a substantial portion of the volume of polishing substance is picked up by the polishing pad 10 as it passes over the polishing substance, and the remainder is worked against the substrate in performance of a polishing operation. The portion that is picked up is dispersed within the pores of the pad 10 and some is stored in the recessed capacity 110 and pores in the area formed by the recess 110 into which a portion of the pad 10 is drawn upon attachment to recess 110.

Recess 110 opens to a perimeter of the backing pad 100, i.e., is open to one the edges, preferably the leading edge 100L, as shown in FIGS. 5A-5C. From the opening 110L at the leading edge 100L, recess 110 extends inwardly toward a center of the surface 106. Recess 106 may be angular in shape (as defined at the surface 106), as illustrated in FIG. 5A. The largest area swept out by the angle 110A occurs at the interface with the leading edge 100L (i.e., at 110L), with the smallest area being swept out at the end of the recess 110I opposite the opening 110L. In FIG. 5A, 110I is at the vertex of the angle 110A. In the embodiment of FIG. 5B, recess 110 is rectangular (in the shape of a parallelogram), with the opening 110L still being larger than the opposite end 110I. In FIG. 5C, the sides 110S of recess 110 are substantially parallel, and therefore 110L is substantially equal in width to 110I. Note also that two of the fastening features 104 are formed in the recess 110 in FIG. 5C, as opposed to all fastening features 104 being outside of the perimeter of recess 110 in FIGS. 5A and 5B. Also it is noted that the shapes of the recesses 110 in FIGS. 5A-5C do not limit the present invention as other shapes may be employed. In each instance however, recess 110 provides capacity for temporary polishing substance storage between the backing pad 100 and the pores 10P in the raised area 10RA of polishing pad 10 which is then dispensed out during polishing.

As noted above, a polishing pad 10 according to the present invention is relatively compressible and is configured to be attached to backing pad 100, to be driven in contact with a surface to be polished. Polishing pad 10 includes at least one substantially straight polishing pad edge 10S along a perimeter thereof that corresponds to and interfaces with the at least one substantially straight backing pad edge 100S when polishing pad 10 is attached to backing pad 100. Thus polishing pad 10 has a shape that corresponds to the shape of backing pad 100. For example, a polishing pad to be used on the backing pad 100 of FIG. 4A would have four substantially straight edges; a polishing pad useable with the embodiment of FIG. 4D would have two substantially straight edges and a curved edge, and a polishing pad for use with the embodiment of FIG. 4E would have four substantially straight edge, with one of the four substantially straight edges being wavy and corresponding in length and shape to the wavy edge of FIG. 4E.

Figure 6A:
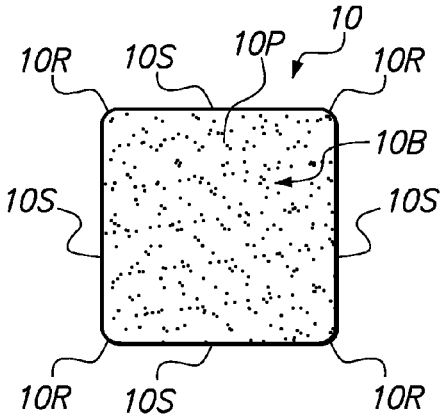
FIGS. 6A-6C illustrate top, side and bottom views, respectively, of a polishing pad according to an embodiment of the present invention.
Figure 6B:
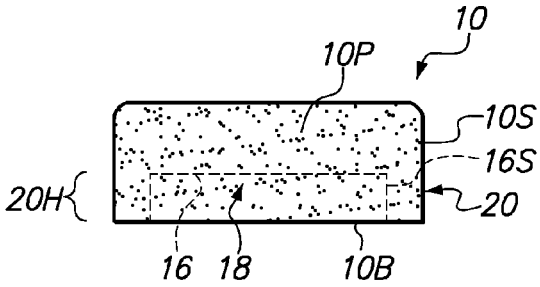
Figure 6C:
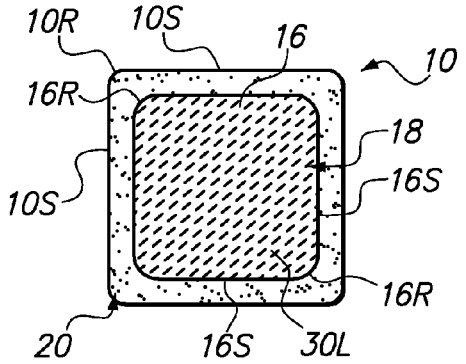

FIGS. 6A-6C illustrate top, side and bottom views, respectively, of a polishing pad 10 according to an embodiment of the present invention. In this embodiment, polishing pad 10 has a substantially square perimeter with rounded corners 10R and substantially straight edges 10S such that polishing pad 10 is configured and dimensioned to interface with the backing pad 100 of FIG. 4B. However, polishing pad 10 is not limited to these dimensions and shapes, as both may vary. As noted above, the perimeter of the polishing pad 10 typically has substantially the same shape as the shape of the perimeter of the backing pad 100 that it is designed to interface with, and it is dimensioned to interface with the backing pad 100. More specifically, the area of the surface 16 (top surface when installed on a backing pad 100 and oriented as in FIGS. 1-3) 16 designed to interface with surface 106 should be at least as great as the area of 106, and may be slightly greater, but not less. As another alternative, such as in embodiments where the polishing pad has a recess and wraps around the perimeter of the backing pad, the polishing pad edges may conform to the backing pad edges. Thus, for example, the backing pad may have a wavy edge while the corresponding edge of the polishing pad installed thereon may be straight, and conform to the wavy edge when installed on the backing pad (e.g., see pad polishing pad 10 of FIG. 8D that has recess 18 and straight edge 10S configured to conform to wavy edge 100S of pad 100 in FIG. 4E when installed thereon), or may initially have a wavy edge that conforms to the wavy edge contour of the backing pad (e.g., see wavy edge 10S in FIG. 8E that substantially conforms to wavy edge 100S in FIG. 4E).

Figure 7A:
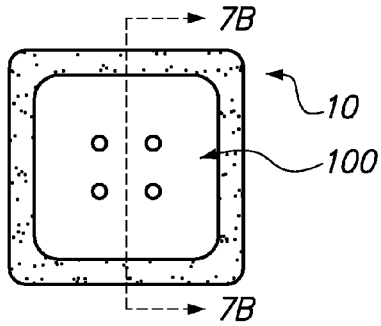
FIG. 7A illustrates a top view of a backing pad having been received in the recess of a polishing pad according to an embodiment of the present invention.
Figure 7B:
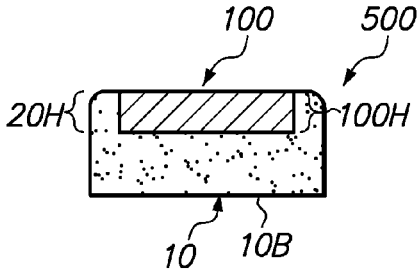
FIG. 7B is a cross-sectional view of FIG. 7A taken along line 7B-7B in FIG. 7A.

In the embodiment of FIGS. 6A-6C, a recess 18 is formed in the top side (top side when pad 10 is oriented as shown in FIG. 1) of pad 10 (see FIGS. 6B-6C) that is dimensioned and shaped to receive backing pad 100 therein as illustrated in FIG. 7A. Thus, the perimeter of top surface 16 in FIG. 6C has a substantially square perimeter with rounded corners 16R and substantially straight edges 16S such that recess 18 and top surface 16 of polishing pad 10 are configured and dimensioned to receive and interface with the backing pad 100 of FIG. 4B. A perimeter portion 20 of the polishing pad 10 has a height 20H defined by the distance from the top surface 20T of perimeter 20 to the top surface 16, is greater than or equal to the height 100H of backing pad 100, see FIG. 7B. This enables the perimeter portion 20 to completely cover the sides of the backing pad 100, as shown in FIG. 7B. The compressibility of the perimeter portion 20 provides a safety cushion to the sides and corners of the backing pad 100, thereby greatly reducing the risk of damage to objects that would otherwise be contacted by the sides and/or corners of the backing pad 100 during a polishing operation.

The top surface 16 of polishing pad 10 is removably attached to the bottom surface 106 of backing pad 100 so that it is sufficiently secure that it does not move relative to the backing pad 100 during polishing operations. Additionally, the attachment is such that the polishing pad 10 can be readily detached from the backing pad to allow a fresh or different polishing pad 10 to be attached to the backing pad, while not requiring an inordinate amount of time to do so, so that the polishing process is efficient. In this regard, the embodiment of FIG. 6C employs as a fastener 30 a hook and loop type fastener (such as VELCRO or the like) with the loop portion 30L of the fastener 30 fixed to the top surface 16 of polishing pad 10 and the hook portion 30H fixed to the bottom surface 106 of backing pad 100 (e.g., see FIGS. 9A-9B). Alternatively, the loop portion 30L may be affixed to the bottom surface 106 and the hook portion 30H may be affixed to the top surface 16. Further alternatively, fastener 30 may be an adhesive. Further alternatively, perimeter 20 may contain an elastic band (not shown) therearound or therethrough so that when polishing pad 10 is mounted on backing pad 100, the elastic band draws against the sides of the backing pad 100 thereby holding the polishing pad 10 attached to the backing pad. Similarly, if 20H is provided to be greater than 100H, then the elastic band can further contract adjacent to the bottom surface of the backing pad, inwardly of the perimeter formed by the sides, thereby maintaining the polishing pad 10 mounted on the backing pad 100 until the operator stretches the elastic band back out to pull it over the perimeter of the backing pad 100 to allow detachment of the polishing pad 10 therefrom. In either of the previous two alternative embodiments, a drawstring (not shown) can be substituted for, or used in addition to the elastic band.

Figure 8A:
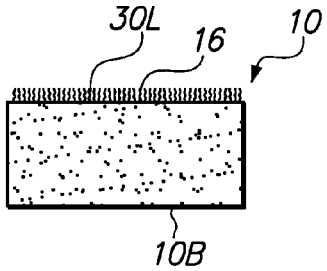
FIGS. 8A-8B illustrate a side view and a top view, respectively of a polishing pad according to another embodiment of the present invention.
Figure 8B:
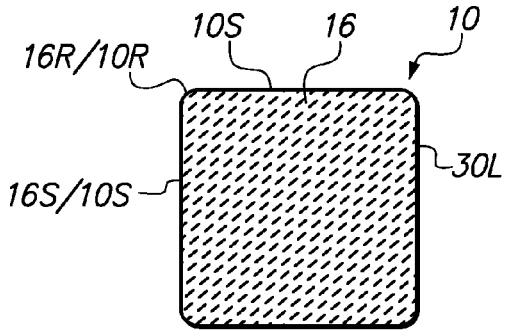
Figure 8C:
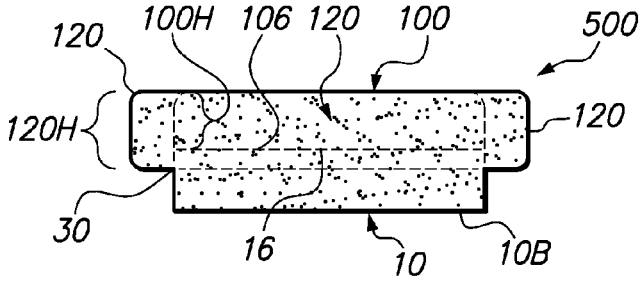
FIG. 8C illustrates the polishing pad of FIGS. 8A-8B attached to a backing pad and strip(s) attached to sides of the backing pad.
Figure 8D:
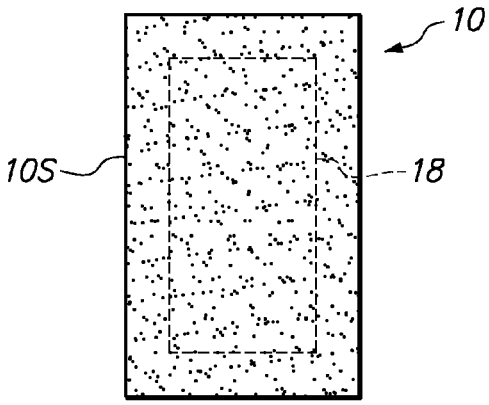
FIG. 8D illustrates a bottom view of a polishing pad according to an embodiment of the present invention.
Figure 8E:
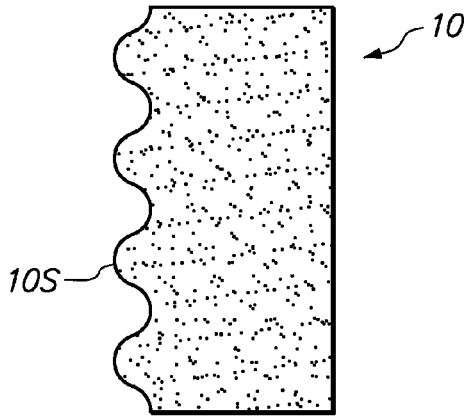
FIG. 8E illustrates a bottom view of a polishing pad according to another embodiment of the present invention.

In the embodiment of FIGS. 8A-8C, polishing pad 10 does not include a recess like the recess 18 of FIGS. 6A-6C, but rather, has substantially planar top and bottom surfaces. In this embodiment, polishing pad 10 has a substantially square perimeter with rounded corners 10R and substantially straight edges 10S such that polishing pad 10 is configured and dimensioned to interface with the backing pad 100 of FIG. 4B. However, polishing pad 10 is not limited to these dimensions and shapes, as both may vary. As noted above, the perimeter of the polishing pad 10 has substantially the same shape as the shape of the perimeter of the backing pad 100 that it is designed to interface with and it and is dimensioned to interface with the backing pad 100. More specifically, the area of the surface 16 (FIG. 8B, i.e., the (top surface when installed on a backing pad 100 and oriented as in FIGS. 1-3) designed to interface with surface 106 should be at least as great as the area of 106, and may be slightly greater, but not less. In this embodiment however, there are no perimeter areas 20 formed by a recess 18. Rather, the perimeter of the top surface 16 is substantially of the same shape and dimensions as the perimeter of the bottom surface 10B.

Thus, the perimeter of top surface 16 (as well as the perimeter of the bottom surface 10B) in FIGS. 8A-8C has a substantially square perimeter with rounded corners 16R/10R and substantially straight edges 16S/10S such that the top surface 16 of polishing pad 10 is configured and dimensioned to interface and fit with the backing pad 100 of FIG. 4B. Additionally bumper pads/strips 120 each having a height 120H greater than or equal to the height 100H of backing pad 100 (see FIG. 8C, where 120H is greater than 100H) are attached to the sides of the backing pad 100 as illustrated in FIG. 8C. Strips/pads may be attached by hook and loop fasteners, adhesives, or the like. This enables the strips/pads 20 to completely cover the sides of the backing pad 100, as shown in FIG. 8C. The compressibility of the strips/pads 120 provides a safety cushion to the sides and corners of the backing pad 100, thereby greatly reducing the risk of damage to objects that would otherwise be contacted by the sides and/or corners of the backing pad 100 during a polishing operation. Alternatively, a single strip/pad 120 may be formed with an inside perimeter that matches the perimeter of the backing pad 100, so that the strip/pad 120 can be attached and detached as a unit with a single action, rather than having two remove and replace four individual strips/pads 120

The top surface 16 of polishing pad 10 is removably attached to the bottom surface 106 of backing pad 100 so that it is sufficiently secure that it does not move relative to the backing pad 100 during polishing operations. Additionally, the attachment is such that the polishing pad 10 can be readily detached from the backing pad to allow a fresh or different polishing pad 10 to be attached to the backing pad, while not requiring an inordinate amount of time to do so, so that the polishing process is efficient. In this regard, the embodiment of FIGS. 8A-8C employs as a fastener 30 a hook and loop type fastener (such as VELCRO or the like) with the loop portion 30L of the fastener 30 fixed to the top surface 16 of polishing pad 10 and the hook portion 30H fixed to the bottom surface 106 of backing pad 100 (e.g., see FIGS. 9A-9B). Alternatively, the loop portion 30L may be affixed to the bottom surface 106 and the hook portion 30H may be affixed to the top surface 16. Further alternatively, fastener 30 may be an adhesive.

Figure 9B:
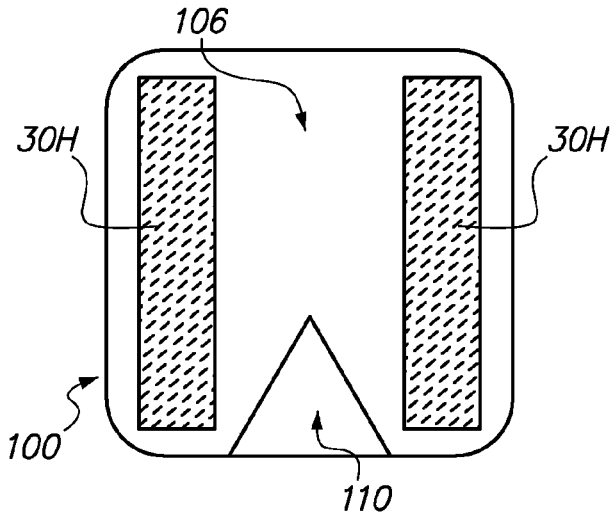
Figure 9C:
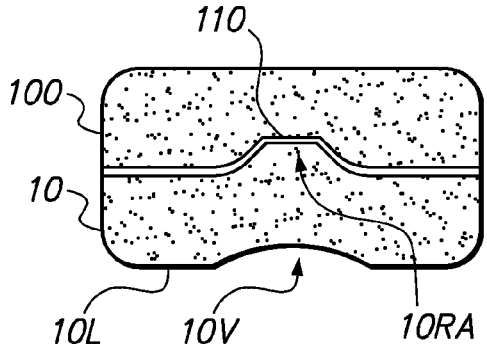
FIG. 9C illustrates a front end view of a polishing pad attached to the backing pad of FIG. 9A.

FIGS. 9A-9B illustrate alternative embodiments of fasteners 30 (in this case, hook portions 30H of hook and loop type fasteners) attached to bottom surface 106 of backing pad 100. In FIG. 9A, fastener 30H covers substantially the entire area of the bottom surface, including the area occupied by recess 110. This facilitates the formation of a void 10V along the leading edge 10L as shown in FIG. 9C in the manner already described above. In FIG. 9B, strips of fastener 30H are attached to surface 106, so that a majority of the area of surface 106 is covered, but the area occupied by recess 110 is not covered.**

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

That which is claimed is:

1. A polishing system adapted for use in conjunction with a polisher, said system comprising:

a relatively incompressible backing pad configured to be attached to a drive system of the polisher; and a relatively compressible polishing pad configured to be attached to said backing pad, to be driven in contact with a surface to be polished, said polishing pad comprising at least one substantially straight polishing pad edge along a perimeter thereof corresponding to said at least one substantially straight backing pad edge when said polishing pad is attached to said backing pad;

wherein said backing pad comprises a substantially planar backing surface to which said polishing pad is attachable, said backing pad further comprising a recess extending inwardly from said substantially planar backing surface along a portion of said backing surface, and inwardly from a perimeter of said backing surface, said recess configured as a capacity for a polishing substance.

2. The system of claim 1, wherein said backing pad comprises a rectangular backing pad perimeter and said polishing pad comprises a rectangular polishing pad perimeter.

3. The system of claim 1 wherein said backing pad includes a wavy edge.

4. The system of claim 1, wherein said polishing pad includes a wavy edge.

5. The system of claim 1, wherein said backing pad comprises at least one substantially straight backing pad edge along a perimeter thereof.

6. The system of claim 5, wherein said recess is angular in shape with a largest portion of said angular shape opening outwardly toward said perimeter of said backing pad.

7. The system of claim 1, wherein said recess extends from said perimeter, inwardly toward a center of said backing surface.

8. The system of claim 1, wherein said polishing pad forms a void along a portion of a leading edge thereof, between said polishing pad leading edge and a substrate, when a portion of said polishing pad is attached to said recess and said polishing pad is contacted to said substrate.

9. The system of claim 1, comprising a raised portion of said polishing pad resulting from attaching said polishing pad to said recess.

10. The system of claim 1, in combination with the polisher.

11. The combination of claim 10, wherein said polisher comprises an orbital polisher.

12. The combination of claim 10, further comprising a dispenser mount attached to said polisher and configured to releasably hold a polishing substance dispenser therein.

13. The combination of claim 12, further comprising a polishing substance dispenser releasably mounted in said dispenser mount.

14. The combination of claim 13, further comprising a retention strap configured to help retain said polishing substance dispenser in said dispenser mount.

15. The combination of claim 14, wherein said retention strap comprises at least one end that is releasably attachable to another portion of said combination.

16. The combination of claim 14, wherein said retention strap is elastic.

17. The combination of claim 13, wherein said dispenser mount forms a friction fit with said polishing substance dispenser.

18. The combination of claim 13, wherein said dispenser mount forms a snap fit with said polishing substance dispenser.

19. A backing pad for a polishing system adapted for use in conjunction with a polisher; said backing pad comprising:

a relatively incompressible backing pad configured to be attached to a drive system of the orbital polisher, said backing pad comprising a substantially planar backing surface configured to be attached to a polishing pad, said backing pad further comprising a recess extending inwardly from said substantially planar backing surface along a portion of said backing surface, and inwardly from a perimeter of said backing surface, said recess configured as a capacity for a polishing substance; wherein said backing pad comprises at least one substantially straight backing pad edge along a perimeter thereof.

20. The backing pad of claim 19, wherein said recess extends from said perimeter, inwardly toward a center of said backing surface.

21. The backing pad of claim 19, wherein said recess is angular in shape with a largest portion of said angular shape opening outwardly toward said perimeter of said backing pad.

22. The backing pad of claim 19, further comprising at least one compressible strip attached to said perimeter and extending upwardly from said substantially planar surface, each said at least one compressible strip being provided to prevent marring due to contact of said relatively incompressible backing pad with a surface that said incompressible pad would otherwise contact during a polishing operation.

23. The backing pad of claim 19, further comprising fastening material affixed to said substantially planar surface, said fastening material configured to releasably attach to mating fastening material on a polishing pad.

24. A polishing pad for a polishing system adapted for use in conjunction with a polisher; said polishing pad comprising:

a relatively compressible polishing pad configured to be attached to a relatively incompressible backing pad, said polishing pad having a top surface configured to interface with a surface of the backing pad upon attachment to the backing pad, and a bottom surface opposite said top surface, said bottom surface configured to contact a surface to be polished;

wherein said bottom surface is substantially planar except for a recessed portion, upon attachment to the backing pad, said recessed portion open to a perimeter of said polishing pad and being recessed above a level of a remainder of said bottom surface, such that a distance between said top surface and said recessed portion is less than a distance between said substantially planar remainder of said bottom surface and said top surface.

25. The polishing pad of claim 24, further comprising a recess in a back surface of said polishing pad, wherein a perimeter portion of said backing pad extends upwardly from said recess along and externally of a perimeter of said recess, said perimeter portion having a height sufficient to prevent marring that would otherwise be caused by contact of said relatively incompressible backing pad with a surface when said polishing pad is attached to the backing pad.

26. The polishing pad of claim 24, wherein said perimeter of said polishing pad is rectangular.

27. The polishing pad of claim 24, wherein said recessed portion is configured such that when said remainder of said bottom surface contacts the surface to be polished, said recessed portion remains out of contact with the surface to be polished.

28. The polishing pad of claim 24, wherein said recessed portion opens to a leading edge of said bottom surface.

29. The polishing pad of claim 24, wherein said polishing pad comprises at least one substantially straight polishing pad edge along a perimeter thereof, configured to interface with at least one substantially straight backing pad edge when said polishing pad is attached to the backing pad.

30. A polishing pad for a polishing system adapted for use in conjunction with a polisher; said polishing pad comprising:

a relatively compressible polishing pad configured to be attached to a relatively incompressible backing pad, said polishing pad having a top surface configured to interface with a surface of the backing pad upon attachment to the backing pad, and a bottom surface opposite said top surface, said bottom surface configured to contact a surface to be polished;

wherein said top surface comprises a raised portion extending from a perimeter of said polishing pad, upon attachment to the backing pad, said raised portion being raised above a level of a remainder of said top surface, such that a distance between said bottom surface and said raised portion, measured at the perimeter of said polishing pad is greater than a distance between said remainder of said top surface and said bottom surface measured at the perimeter of said polishing pad.

31. The polishing pad of claim 30, wherein said bottom surface comprises a recessed portion, upon attachment to the backing pad.

32. The polishing pad of claim 31, wherein said recessed portion is configured such that when said remainder of said bottom surface contacts the surface to be polished, said recessed portion remains out of contact with the surface to be polished.

33. The polishing pad of claim 31, wherein said recessed portion opens to a leading edge of said bottom surface.

* * * * *